US006661305B1

(12) United States Patent
Rosenberg et al.

(10) Patent No.: US 6,661,305 B1
(45) Date of Patent: Dec. 9, 2003

(54) WAVE GUIDE ADAPTER

(75) Inventors: Uwe Rosenberg, Backnang (DE); Martin Schneider, Sandaecker (DE)

(73) Assignee: Marconi Communications GmbH, Backnang (DE)

( * ) Notice: Subject to any disclaimer, the term of this patent is extended or adjusted under 35 U.S.C. 154(b) by 12 days.

(21) Appl. No.: 10/049,175

(22) PCT Filed: Aug. 10, 2000

(86) PCT No.: PCT/IB00/01177

§ 371 (c)(1),
(2), (4) Date: Jun. 10, 2002

(87) PCT Pub. No.: WO01/11713

PCT Pub. Date: Feb. 15, 2001

(30) Foreign Application Priority Data

Aug. 10, 1999 (DE) ..... 199 37 725

(51) Int. Cl.[7] ..... H01P 1/32
(52) U.S. Cl. ..... 333/21 R; 333/24 R
(58) Field of Search ..... 333/21, 24, 113, 333/114, 248, 112, 116

(56) References Cited

U.S. PATENT DOCUMENTS

| | | | | |
|---|---|---|---|---|
| 3,750,183 A | | 7/1973 | Drabowitch | |
| 4,540,959 A | | 9/1985 | Saad | |
| 5,583,468 A | * | 12/1996 | Kielmeyer et al. | 333/33 |
| 6,127,902 A | * | 10/2000 | Speldrich et al. | 333/113 |
| 6,388,538 B1 | * | 5/2002 | Meier | 333/24 R |

* cited by examiner

*Primary Examiner*—Brian Young
*Assistant Examiner*—Joseph Lauture
(74) *Attorney, Agent, or Firm*—Kirschstein, et al.

(57) ABSTRACT

A waveguide adapter is arranged between a rectangular waveguide with a single cross-section and an elliptical waveguide which allows for the propagation of a fundamental wave type and higher wave types. The adapter includes a longitudinal channel which allows for the propagation of higher types of waves at least on one part of the length thereof and consists of various stages with different cross-sections. The adapter also has waveguide gates which are used to couple higher waves of the elliptical waveguide. The stages of the waveguide adapter in which the higher wave types are propagated have an elliptical cross-section.

10 Claims, 2 Drawing Sheets

WAVE GUIDE ADAPTER

The present invention concerns a waveguide transition for low reflection transmission of electromagnetic energy between the fundamental wave type of a rectangular waveguide with a distinct cross section and the fundamental wave type of an elliptical waveguide that permits propagation of the fundamental wave type and higher wave types with a longitudinal channel that permits, on at least one part of its length, propagation of higher wave types and includes a number of steps of different cross section following in succession in the transmission direction and with waveguide gates that lead to the longitudinal channel for coupling to higher wave types of the elliptical waveguide.

This type of waveguide transition is known from DE 38 36 545 C2. Such waveguide transitions are used in high frequency transmission lines in which a high frequency wave must be transmitted with low attenuation over long distances.

Waveguides with a unique cross section, i.e., waveguides in which an electromagnetic wave of a given frequency is only capable of propagation in the fundamental wave type, are preferred for a number of transmission purposes, since the excitation of standing waves of higher wave types in them, which can sensitively affect transmission of a transmission line for certain frequencies, is ruled out. Such unique waveguides, however, in turn have much higher attenuation than waveguides with correspondingly larger cross section, so that the latter are preferred for low-attenuation transmission over longer distances. These waveguides, also referred to as transport waveguides, generally have an elliptical cross section, since these exhibit not only lower attenuation relative to rectangular waveguides, but also have particularly good laying and handling properties so that entire waveguide systems with curvatures can be constructed from one part.

A problem in using such "overmoded" waveguides is that a smaller part of the electromagnetic energy of the fundamental wave type is converted into higher wave types capable of propagation on curvatures and other small interference sites of the waveguide system; the standing waves (resonances) of the higher wave types caused by this can have a sensitive adverse effect on transmission. In order to achieve transmission with high efficiency, it is necessary, for the fundamental wave type of the unique waveguide to be effectively coupled to the fundamental wave type of the transport wave guide, in which excitation of higher wave types in the transition itself is almost suppressed and the higher wave types unavoidably excited in the transport waveguide are effectively attenuated in order to prevent formation of resonances.

ADVANTAGES OF THE INVENTION

With the present invention, a waveguide transition of the type just mentioned is devised in which the higher wave types occurring in the overnoded waveguide system are effectively coupled. Only in this way is almost complete attenuation of these higher wave types possible. This advantage is achieved by providing elliptical steps in the overmoded section of the transition, so that reflections and therefore non-optimal coupling of the higher wave types that occur in a transition from a rectangular to an elliptical cross section because the wave types are not congruent (as in the known transition) are avoided.

By this expedient, all transformation steps in the overmoded section have ellipse-like cross sections.

The transition to an elliptical cross section of the transport waveguides occurs over several steps, in which the number of wave types capable of propagation can increase in each step as a function of its cross-sectional dimensions.

To achieve simple production of the waveguide transition, the waveguide gates that are situated perpendicular to the axis of the transition and sealed with absorbers are preferably arranged in one step. This means that the cross sections of the individual transformation steps are chosen so that the short circuit planes of the wave types on the waveguide gate, whose large cross-sectional dimension is oriented across the axis of the transition, have a spacing of no more than ⅙ of their waveguide wavelength relative to this gate and that the short circuit planes of the wave types on the perpendicular wavegliide gate, whose large dimension lies along the axis of the transition, have a spacing of ? to ? of their waveguide wavelength (preferably about ¼) relative to this gate. Such positioning means that the higher wave types of the transport waveguide are effectively coupled.

The waveguide transition preferably has two elongated gates perpendicular to its axis, which are spaced in the direction of the major axis of the elliptical cross section. Two waveguide channels can be connected to these two gates, each of which is connected to arms of a T-piece. Such a design makes it possible to couple a second wave type independently of the fundamental wave type in the transport waveguide with which a second signal can be additionally be transmitted with a transport waveguide decoupled to the signal of the fundamental wave type.

A chamber containing a damping material to dampen the coupled-in wave types is connected to at least one of the gates.

The waveguide transition can be produced in simple fashion by milling the longitudinal channel with a tool guided parallel to the longitudinal axis of the waveguide transition. This makes it possible to keep the number of parts of the waveguide transition limited and thus avoid tightness problems. The tightness of the waveguide transition is significant because waveguide systems are generally operated with a slight overpressure in order to avoid an adverse effect on their function by penetration of moisture.

The entire waveguide transition according to the invention can be made from a single piece in which the gates are milled with a tool guided perpendicular to the longitudinal axis of the waveguide transition. As an alternative it is also possible for the waveguide transition to contain two pieces that join on a surface that intersects the gates. In this manner the length and number of required seals is kept limited and tightness problems are avoided.

Additional features and advantages of the invention are apparent from the following description of practical examples with reference to the figures.

FIGURES

DESCRIPTION OF THE PRACTICAL EXAMPLES

Figure 1:
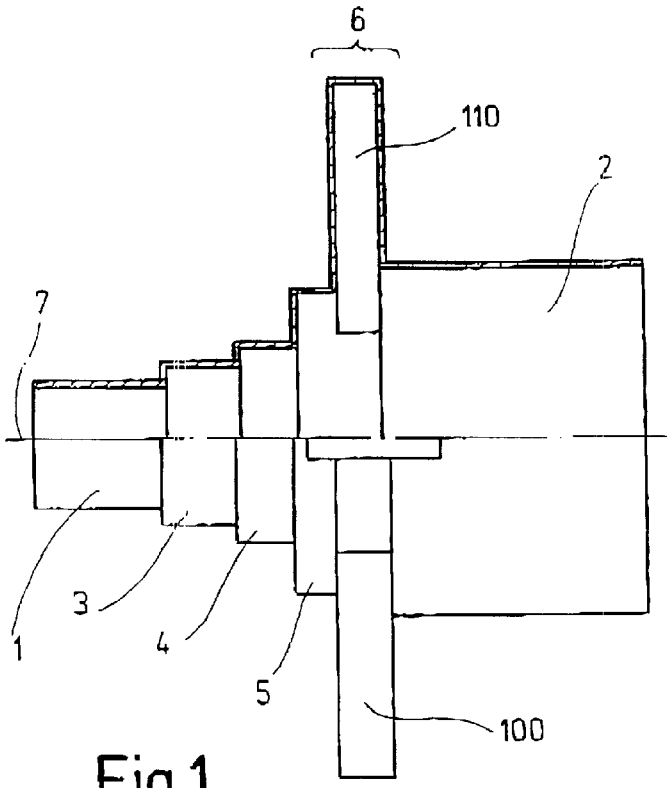
FIGS. 1 to 3 show the waveguide transition according to a first embodiment in two side views and a top view in the axial direction.

A first practical example of the waveguide transition is shown in FIG. 1 in a side view. The transition with three steps 3, 4, 5, whose elliptical cross sections increase from rectangular waveguide 1, is connected to rectangular waveguide 1 with a unique cross section (only the fundamental wave type H10 is capable of propagation). The cross section of the narrowest step 3 is also unique. Step 6 is connected, forming a five-gate branch with three waveguide gates 10, 11, 12 that discharge perpendicular to the direction of propagation of the high frequency wave or to axis 7, as is apparent in particular in the partially cut-away top view of FIG. 2.

Figure 2:
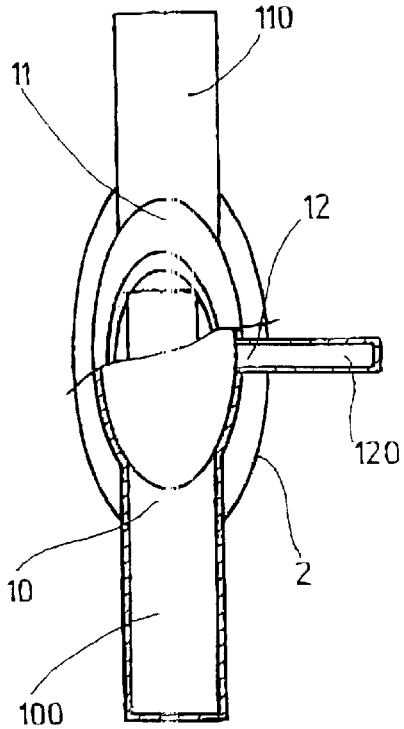

Gates 10, 11, 12, connected perpendicular to the axis of the transition, have a unique cross section for the useful frequency range, i.e., only the corresponding fundamental wave type (H10) is capable of propagation in waveguide sections 100, 110, 120 connected to the gates. Waveguide gates 10, 11 lie in the direction of the semi-major axis of the elliptical cross section at a spacing relative to the cutting plane depicted in FIG. 2. The broad sides of these waveguide gates 10, 11 are parallel to the semi-minor axis. The higher oscillation types of the elliptical waveguide, which have wall currents along the direction of propagation in the region of the gates, such as Hs11, Hs21, Ec01, Ec11, couple the H10 wave type of these waveguide gates 10, 11. To achieve effective coupling of these wave types, the dimensions of steps 3, 4 and 5 are chosen so that short circuit planes are produced for these wave types, whose spacing from the cutting plane FIG. 2 is less than ⅙ of the wavelength of the corresponding wave type. By appropriate choice of the dimensions of steps 3 to 6, a situation can be achieved in which the limiting wavelengths of individual wave types and, as a result, their short circuit planes, coincide. It is thus possible to couple these wave types effectively to gates 10, 11 by optimization of the dimensions of a small number of steps.

A third gate 12 is arranged on the semi-minor axis of the ellipse shape of step 6, the broad side of this gate extending in the axial direction of the transition. The H10 wave type of this gate couples wave types that induce wall currents across the direction of propagation, such as Hc2, HS11. In these wave types, a condition for effective coupling is that the short circuit plane be situated at a distance of about ? to ?, preferably ¼, of the waveguide wavelength of the corresponding wave type from gate 12.

In the practical example, the lateral gates are situated in the region of the last transformation step of the transition to the elliptical waveguide. Few reflections therefore occur for the higher wave types that can develop in the transport waveguide, i.e., they can be effectively coupled to the corresponding lateral waveguide gates. This last step of the transition could also be congruent to the transport waveguide connected to it in order to also avoid limited reflections on the boundary to transport waveguide 2.

With the semi-major and semi-miinior axes and the lengths of the individual elliptical steps sufficiently free parameters are available with which the corresponding short circuit plane of the higher wave types can be optimally positioned for the useful frequency range and very good adaptation can be achieved for the fundamental wave types of rectangular waveguide 1 and transport waveguide 2. It is then also possible for the ratio of the semi-major to semi-minor axes to be different for different steps.

Chambers 100, 110, 120 with the same cross sections as the gates are connected to gates 10, 11, 12. These chambers contain an absorbing material that dampens the electromagnetic energy of the higher wave types coupled into the chambers.

Figure 3:
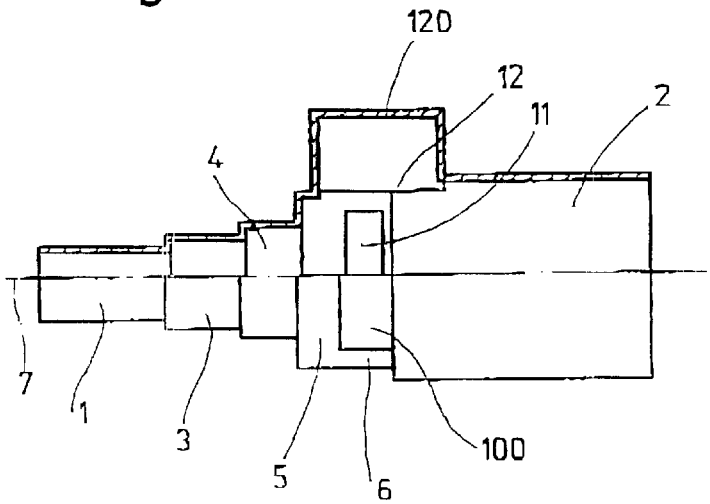

FIG. 3 shows in another perspective the waveguide transition with waveguides 1, 2, connected to it and the orientation of the gates.

Figure 4:
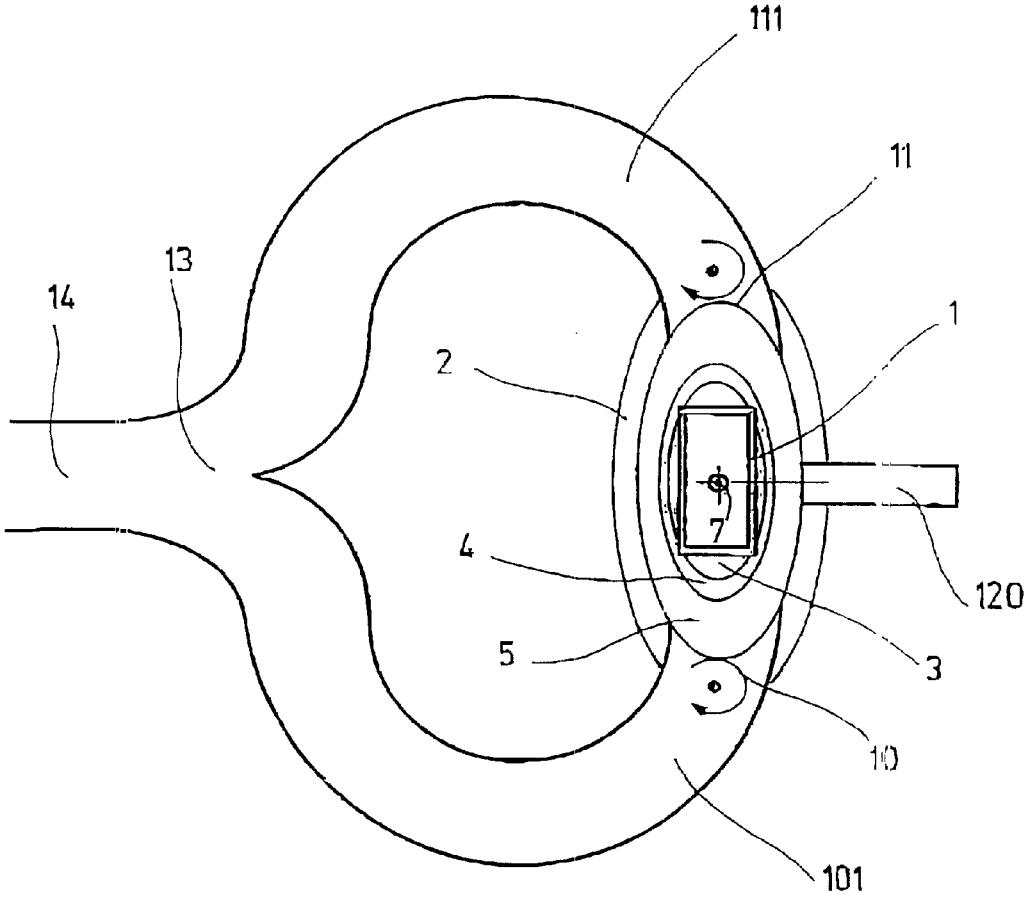
FIG. 4 shows a top view in the axial direction of a second embodiment of the waveguide transition.

In the embodiment depicted in FIG. 4 in a top view from the direction of the rectangular waveguide 1, the chambers 100, 110 are replaced by rectangular waveguides 101, 111. whose cross section corresponds to that of gates 10, 11, and which are assembled into a single conductor 14 at T-piece 13. Tile waveguides 101, 111 have the same lengths and a unique cross section on which only the H10 oscillation type is capable of propagation.

An electromagnetic wave fed into connection gate 14 is divided by the T-branch into two equally large fractions. Opposite wall currents directed parallel to the axis of transition are then produced by the arrangement at the locations of gates 10, 11, which couple the Ec01 wave type of the overmoded transport waveguide 2. The Hc11 fundamental wave type is decoupled, since it has only wall currents perpendicular to the direction of propagation in the region of gates 10, 11. It is thus possible via waveguide 14 to deliberately excite wave type Ec01 of the overmoded waveguide and tap the excited oscillation again at a correspondingly designed transition on the other end of the overmoded waveguide 2. In this manner, the waveguide can be used for simultaneous transmission of two communications channels free of interaction, which are modulated on one of the two wave types.

The waveguide transition is simply produced by milling. The longitudinal channel, for example, can then be produced by means of a milling head that is introduced from the side of the largest step 6 into a one-piece blank and the individual steps successively milled out. The gates are then cut and milled from the sides and chambers 100, 110, 120, or waveguides 101, 111 mounted airtight on them. The transition can also be produced in two pieces that border each other in a plane running through gates 10, 11, 12, for example, the plane of the section in FIG. 2. In this case it is possible to completely mill out chambers 10, 11, 12 on one of the two pieces from said plane and then join them airtight.

What is claimed is:

1. A waveguide adapter for low reflection transmission of electromagnetic energy between a rectangular waveguide having a single cross-section for permitting propagation of a fundamental wave type, and an elliptical waveguide for permitting propagation of the fundamental wave type and higher wave types, comprising: a longitudinal channel for permitting propagation along a direction of transmission of the higher wave types on at least a part of a length of the longitudinal channel, the longitudinal channel having a plurality of stages of different cross-section following in succession in the direction of transmission, and waveguide gates for coupling to the higher wave types of the elliptical waveguide, said stages in which the higher wave types are capable of propagation having an elliptical cross-section.

2. The waveguide adapter according to claim 1, wherein all the gates are arranged in walls of one of the stages, and wherein the stages have cross-sections chosen so that the wave types that induce wall currents parallel to the direction of transmission have a short circuit plane and a spacing of no more than ⅙ of a waveguide wavelength from the gate that couples the stages, and that the wave types that induce wall currents perpendicular to the direction of transmission have a short circuit plane at a spacing of about ¼ of the waveguide wavelength from the gate that couples the stages.

3. The waveguide adapter according to claim 1, wherein two of the gates are elongated perpendicular to an axis of the waveguide adapter, said two gates being spaced in a direction of a semi-major axis of the elliptical cross-section.

4. The waveguide adapter according to claim 3, and comprising waveguide channels connected to the two gates, each of the two gates being connected to arms of a T-piece.

5. The waveguide adapter according to claim 1, and comprising a chamber for containing a damping material, the chamber being connected to at least one of the gates.

6. The waveguide adapter according to claim 1, wherein the longitudinal channel is milled with a tool guided parallel to a longitudinal axis of the waveguide adapter.

7. The waveguide adapter according to claim 6, wherein the adapter is in one piece, and wherein the gates are milled by a tool guided perpendicular to the longitudinal axis of the waveguide adapter.

8. The waveguide adapter according to claim 6, wherein the adapter comprises two pieces that are joined on one surface that intersects the gates.

9. The waveguide adapter according to claim 1, wherein the waveguide gates discharge into one of the stages to which a transport waveguide is connected.

10. An arrangement, comprising: a transport waveguide, and at least one waveguide adapter for low reflection transmission of electromagnetic energy between a rectangular waveguide having a single cross-section for permitting propagation of a fundamental wave type, and an elliptical waveguide for permitting propagation of the fundamental wave type and higher wave types, the adapter including a longitudinal channel for permitting propagation along a direction of transmission of the higher wave types on at least a part of a length of the longitudinal channel, the longitudinal channel having a plurality of stages of different cross-section following in succession in the direction of transmission, and waveguide gates for coupling to the higher wave types of the elliptical waveguide, said stages in which the higher wave types are capable of propagation having an elliptical cross-section, and the transport waveguide having a cross-section congruent with one of the stages connected to the transport waveguide.

* * * * *